US006203226B1

(12) United States Patent
Suzuki et al.

(10) Patent No.: US 6,203,226 B1
(45) Date of Patent: Mar. 20, 2001

(54) SIDE-KNOCK TYPE MECHANICAL PENCIL

(75) Inventors: Takahiko Suzuki; Tadashi Yamamoto, both of Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 0 days.

(21) Appl. No.: 09/499,755

(22) Filed: Feb. 8, 2000

(51) Int. Cl.[7] ..... B43K 21/16

(52) U.S. Cl. ..... 401/65; 401/67; 401/92; 401/93; 401/94

(58) Field of Search ..... 401/92–94, 55, 401/81, 62, 82, 87, 88, 65–67, 106

(56) References Cited

U.S. PATENT DOCUMENTS 3,813,176 * 5/1974 Kamo ..... 401/94
3,836,264 * 9/1974 Saito et al. ..... 401/92
3,854,824 * 12/1974 Kamo ..... 401/94
3,883,253 * 5/1975 Naruse et al. ..... 401/92
3,892,495 * 7/1975 Naruse et al. ..... 401/93
4,627,756 * 12/1986 Kageyama ..... 401/94
4,955,739 * 9/1990 Kageyama et al. ..... 401/92

* cited by examiner

*Primary Examiner*—Gregory L. Huson
*Assistant Examiner*—Tuan Nguyen
(74) *Attorney, Agent, or Firm*—Rothwell, Figg, Ernst & Manbeck

(57) ABSTRACT

A side-knock type mechanical pencil comprising a barrel having an opening in a side wall, a chuck mechanism housed in the forepart of the barrel, a slider moved back and forth within the barrel to open and close the chuck mechanism, a knock lever which is inserted into the opening with an upper front end pivotally mounted with respect to the barrel, a lower front end thereof being placed in contact with the slider, and a resilient member for holding the knock lever in an initial position.

3 Claims, 3 Drawing Sheets

SIDE-KNOCK TYPE MECHANICAL PENCIL

BACKGROUND OF THE INVENTION

1. Field of the Invention

The present invention relates to a mechanical pencil in which a knock-lever mounted in a side wall of a barrel of the mechanical pencil having a chuck mechanism is knocked by a fingertip holding the barrel to draw out lead.

2. Description of the Prior art

FIG. 1 is a longitudinal sectional view showing a conventional side-knock type mechanical pencil. In this drawing, a barrel 11 is provided in the side wall thereof with an opening comprising a first opening portion 13*a* and a second opening portion 13*b* which are continuous through a fulcrum 12 formed at a contact position of a fingertip portion holding the barrel 11 during writing.

A knock lever 14 is mounted in the opening portions 13*a* and 13*b*. As shown in FIG. 2, the knock lever 14 is provided with a knock surface 15 knocked by a fingertip in order to draw out lead, a locking stepped surface 17 continuous to the knock surface 15 and in contact with a stepped surface wall 16 of the barrel 11 at the end of the second opening portion 13*b* to prevent the knock lever 14 from moving backward, a locking surface 18 continuous to the stepped surface 17 and in contact with an inner wall of the barrel 11 and a pair of acting flaps 24 inserted into the barrel 11, ends of which come in contact with an inclined surface 22 of a slider 21 provided on a joint 20, each of the acting flaps 24 being provided with a laterally projecting protrusion 26 to be locked at a locking stepped portion provided axially of the inner wall of the barrel 11.

The knock lever 14 is provided so that the locking surface 18 is inserted into the second opening portion 13*b*, and the locking stepped surface 17 is placed in contact with the stepped surface wall 16, the acting flaps 24 being pressed inward by a finger to press the knock surface 15 in an axial direction of the barrel 11 in a curved state, whereby the flange 26 is locked at the locking stepped portion.

The operation for drawing out lead in the prior art will be described hereinafter. The knock surface 15 is knocked whereby the acting flaps 24 come in contact with the inclined surface 22 of the slider 21 provided on the joint 20, the joint 20 is moved forward along the inner surface of the barrel 11 against a spring 23 to open the chuck mechanism 19 to enable drawing-out of lead.

Since the conventional side-knock type mechanical pencil is constructed as described above, mounting of the knock lever on the barrel is troublesome and requires skill. Further, since the knock lever is pressed in its extreme end portion into the barrel, and the inclined surface of the rear end portion of the slider is pushed by the extreme end portion to advance the slider, it was difficult to take a knock stroke sufficiently. As a result, the opening and closing operation of the chuck mechanism is possibly unreliable. Furthermore, since the knock lever causes the slider to operate directly by the pressing force thereof, the fingertip needs to have great force. In particular, in case of a slide type mechanical pencil of a pipe provided in a tip slide, that is, a tip member, the stroke for pushing out the pipe is necessary, which had been very inconvenient in a so-called inclined surface system making use of an inclined surface portion in prior art.

This invention has been accomplished in order to solve the problem as described above. It is an object of the invention to provide a side-knock type mechanical pencil which is easy in mounting a knock lever on a barrel, and which can take a large knock stroke with small operating force.

SUMMARY OF THE INVENTION

According to this invention, there is provided a side-knock type mechanical pencil comprising a barrel having an opening in a side wall, a chuck mechanism housed in the forepart of the barrel, a slider slidably moved within the barrel to open and close the chuck mechanism, a knock lever which is inserted into the opening and pivotally mounted with respect to the barrel with an upper front end thereof acting as a fulcrum, a lower front end thereof being able to come in contact with the slider, and a resilient member for holding the knock lever in an initial position.

Further, in the side-knock type mechanical pencil according to this invention, a part of the knock lever is projected outside the barrel in the aforesaid initial position.

Furthermore, the resilient member in the side-knock type mechanical pencil according to this invention holds the knock lever in the initial position through the slider.

Further, in the side-knock type mechanical pencil according to this invention, a spherical protrusion is formed at the lower front end of the knock lever in contact with the slider.

DETAILED DESCRIPTION OF THE PREFERRED EMBODIMENTS

Figure 1:
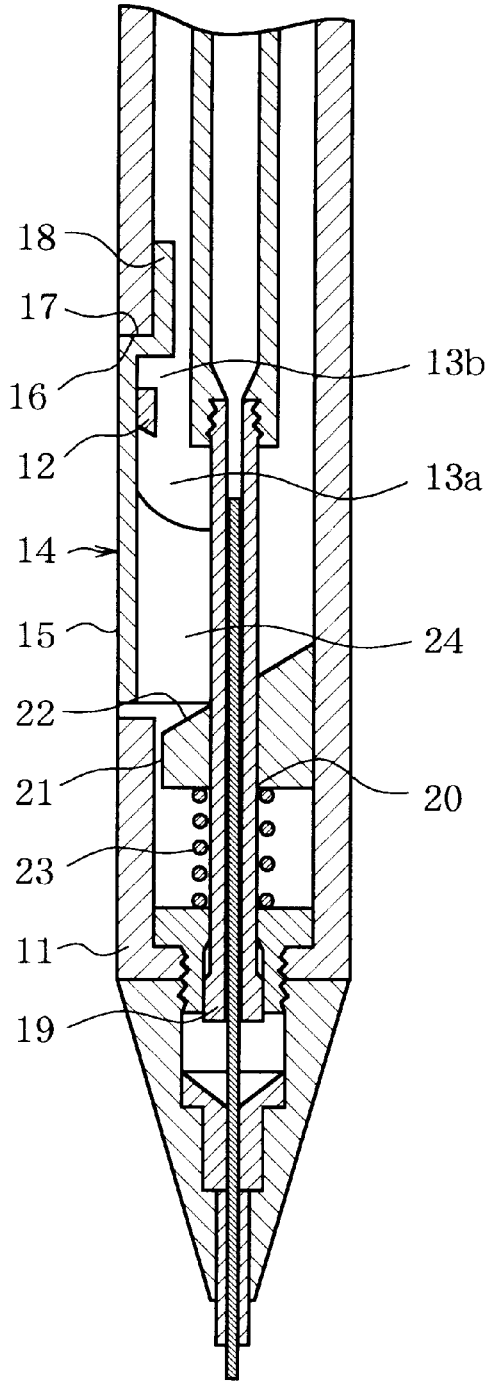
FIG.1 (PRIOR ART)
FIG. 1 is a longitudinal sectional view of a conventional side-knock type mechanical pencil.
Figure 2:
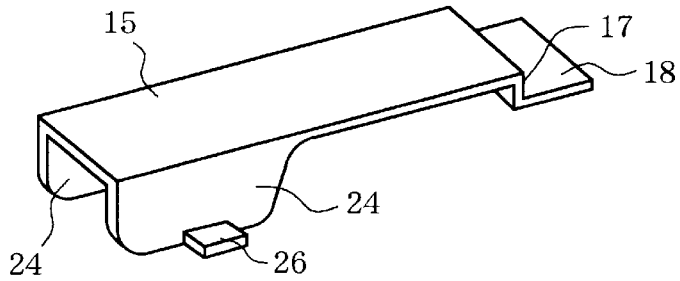
FIG.2 (PRIOR ART)
FIG. 2 is a perspective view of a knock lever in the conventional side-knock type mechanical pencil.
Figure 5:
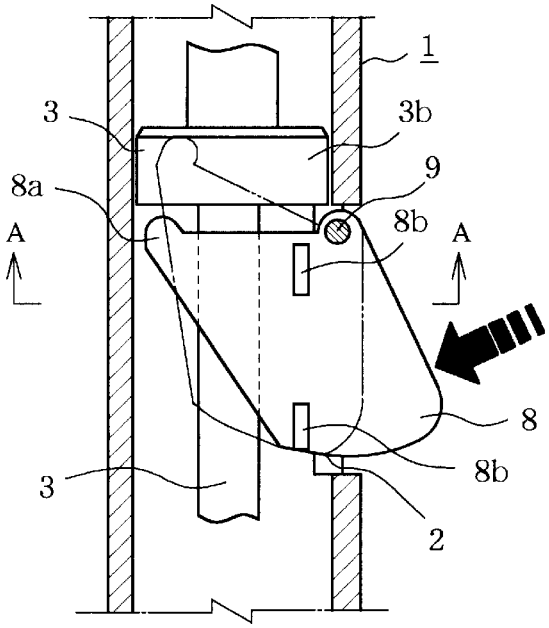
FIG. 5 is an enlarged longitudinal sectional view of a knock lever portion of the side-knock type mechanical pencil.
Figure 6:
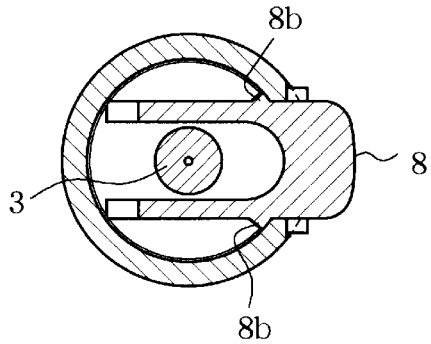
FIG. 6 is a cross-sectional view taken on line A—A of FIG. 5.
Figure 3:
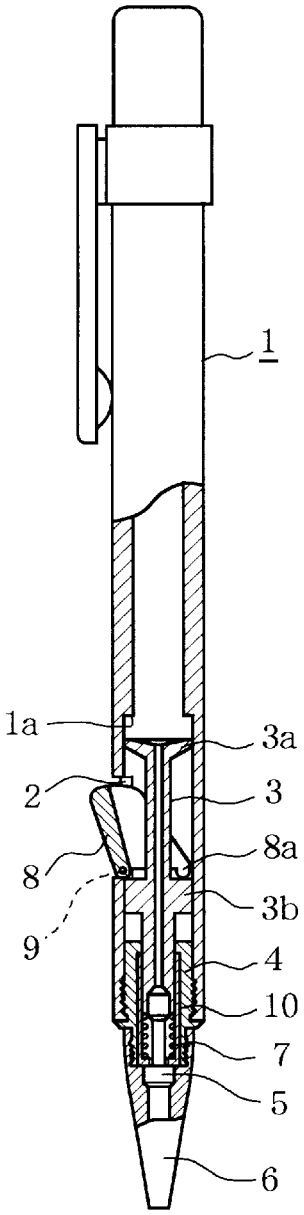
FIG. 3 is a front view of a side-knock type mechanical pencil according to an embodiment of this invention, in which a part of the mechanical pencil is cut away.
Figure 4:
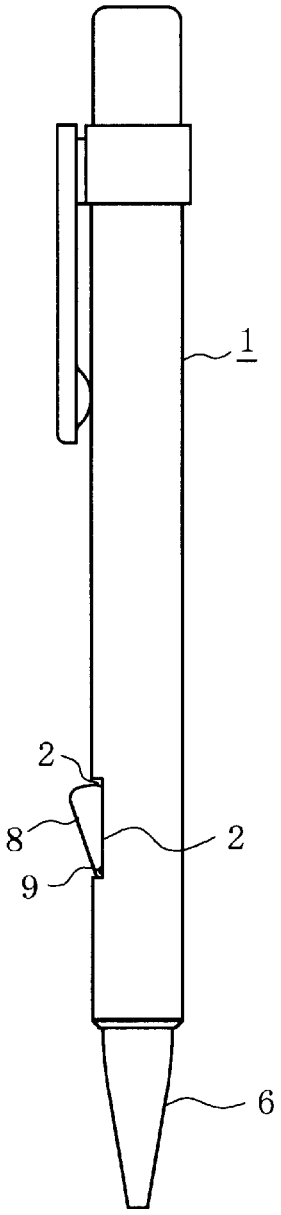
FIG. 4 is a front view of the side-knock type mechanical pencil.

FIG. 3 is a front view with an extreme end of a side-knock type mechanical pencil according to an embodiment of this invention sectioned longitudinally; FIG. 4 is a front view thereof; FIG. 5 is an enlarged longitudinal sectional view of a knock lever portion; and FIG. 6 is a cross-sectional view taken on line A—A of FIG. 5. In the drawings, on the side wall of a barrel 1, an opening 2 is provided in a contact position of a fingertip portion holding the barrel 1 during writing.

A slider 3 is axially movably housed in an extreme end portion of the barrel 1. The slider 3 has a first flange 3*a* at the rear end thereof, and a second flange 3*b* in the intermediate portion thereof. A joint 4 is threadedly engaged within the extreme end portion of the barrel 1, and a chuck 5 is internally disposed. There is provided a convergent tip member 6 threadedly engaged with the outer portion at the extreme end portion of the joint 4. Reference numeral 7 designates a spring as a resilient member housed in a contracted manner between a sleeve 10 and the slider 3, and the slider 3 is pressed backward of the barrel 1 by restoring force of the spring 7.

Reference numeral 8 designates a knock lever in the shape of U as shown in FIG. 6, which is inserted into the hole 2 of the barrel 1, and a corner portion of the upper front end of the U-shape is rotatably mounted with respect to the barrel 1 on a fulcrum 9. The knock lever 8 is formed at lower front portions of both legs of the U-shape with spherical protrusions 8a in contact with the second flange 3*b*, and on both outer walls with engaging protrusions 8*b* in contact with the inner wall surface of the barrel 1 to control the initial position of the knock lever 8, that is, the amount projected from the barrel 1.

Figure 7:
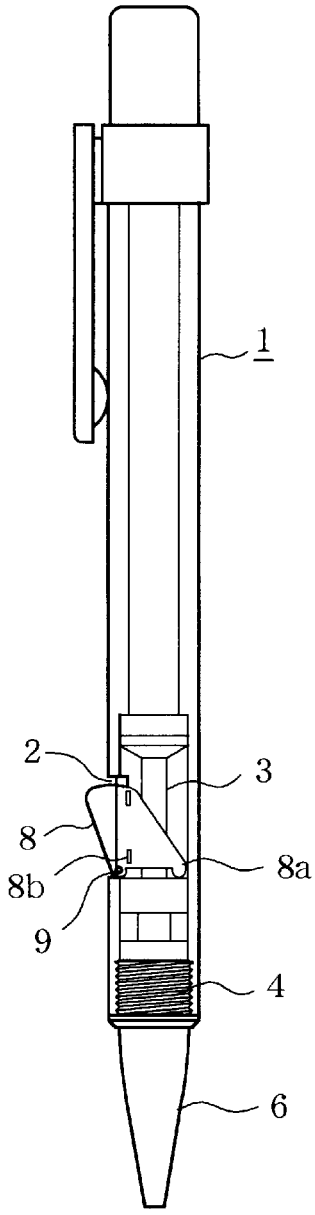
FIG. 7 is a front view of a side-knock type mechanical pencil according to a second embodiment in which a barrel of the pencil is made of transparent material.

Referring to FIG. 7, there is illustrated a sideknock type mechanical pencil according to a second embodiment of the present invention. This embodiment is substantially similar to that of FIGS. 3–6 except that the barrel 1 is made of a transparent material.

The operation of the side-knock type mechanical pencil according to the above-described embodiments will be described hereinafter.

The knock lever 8 is pressed into the opening 2 till the engaging protrusions 8*b* move into the barrel 1 so that both the U-shaped legs straddle the slider 3, to cause the spherical protrusions 8*a* at lower front portions of both legs to contact with the second flange 3*b* of the slider 3 to advance the slider 3, and in a state with the spring 7 slightly compressed, the upper front end of the knock lever 8 is pivotally mounted with respect to the barrel 1 on the fulcrum 9. This state is as shown in the drawing, and the rear end portion of the knock lever 8 is partly projected outside the barrel 1.

When this mechanical pencil is used, the protrusion of the knock lever 8 is pressed into the barrel 1 whereby the spherical protrusion 8*a* in contact with the second flange 3*b* causes the joint 4 to move forward along the inner surface of the barrel 1. As a result, it is possible to open the chuck mechanism 5 to draw out lead.

As described above, according to the present embodiment, the upper front end of the knock lever 8 is pivotally mounted with respect to the barrel 1 whereby a large knock stroke can be obtained by rotation of the knock lever, as a consequence of which the joint 4 can be sufficiently moved within the barrel 1 through the slider 3, and the opening and closing of the chuck mechanism 5 can be positively carried out. Further, the lever 8 is operated to press the rear portion opposite to the support point whereby it can be pivoted under the leverage principle, and since the small press-operating force will suffice, good use can be made.

Further, the knock lever 8 is held at the initial position through the slider 3 by the resilient restoring force of the spring 7 whereby the various parts can be held with less number of parts without play. Moreover, the spherical protrusions 8*a* at the lower front ends of both legs are brought into contact with the second flange 8*b* of the slider 3, whereby the knock lever 8 is able to keep the contact state always, and the lead feeding operation can be carried out smoothly.

As described above, according to this invention, since the upper front end portion of the knock lever is pivotally mounted with respect to the barrel, its mounting can be done simply without requiring skill. The large knock stroke can be obtained by pivot of the knock lever, and the opening and closing of the chuck mechanism can be carried out positively. Further, since the knock lever is operated to press the rear portion opposite to the support point, and it can be pivoted under the leverage principle, the small press-operating force will suffice, good use can be made.

Further, the knock lever 8 is held at the initial position through the slider 3 by the resilient restoring force of the spring 7 whereby the various parts can be held with less number of parts without play. Moreover, there is a further effect such that the spherical protrusions at the lower front ends of both legs are brought into contact with the second flange of the slider, whereby the knock lever is able to keep the contact state always.

What is claimed is:

1. A side-knock type mechanical pencil comprising:

a barrel having an opening formed in a side wall thereof;

a slider axially movably disposed within said barrel;

a chuck mechanism for advancing a writing lead, said slider connected to said chuck mechanism;

a resilient member disposed within said barrel to urge said slider rearwardly;

a knock lever for advancing said slider and causing said chuck mechanism to advance said writing lead, said knock lever having an initial position;

said knock lever being received in said opening of said barrel and pivotally supported on said barrel;

said knock lever having an upper front end and a lower front end, said upper front end being adapted to act as a fulcrum;

a flange provided around a portion of said slider for facilitating the advancing of said slider; and a spherical protrusion provided at said lower front end of said knock lever and projected from said knock lever toward said flange to contact said flange when said knock lever is in said initial position.

2. The side-knock type mechanical pencil according to claim 1, wherein a part of said knock lever is projected outside said barrel in said initial position.

3. The side-knock type mechanical pencil according to claim 1, further including engaging means contacting an inner surface of said barrel to control said initial position of said knock lever.

* * * * *